US012239221B2

(12) United States Patent
Youssef

(10) Patent No.: US 12,239,221 B2
(45) Date of Patent: Mar. 4, 2025

(54) STORAGE SYSTEM

(71) Applicant: Secret Stash Pty Ltd, North Strathfield (AU)

(72) Inventor: Charbel Youssef, North Strathfield (AU)

(73) Assignee: SECRET STASH PTY LTD, North Strathfield (AU)

( * ) Notice: Subject to any disclaimer, the term of this patent is extended or adjusted under 35 U.S.C. 154(b) by 0 days.

(21) Appl. No.: 18/512,290

(22) Filed: Nov. 17, 2023

(65) Prior Publication Data

US 2024/0164516 A1 May 23, 2024

(30) Foreign Application Priority Data

Nov. 18, 2022 (AU) ..... 2022903485

(51) Int. Cl.

| | |
|---|---|
| ***A47B 73/00*** | (2006.01) |
| ***A47B 96/02*** | (2006.01) |
| ***A47B 96/14*** | (2006.01) |
| *A47B 47/00* | (2006.01) |
| *A47B 57/58* | (2006.01) |

(52) U.S. Cl.

CPC ..... *A47B 73/00* (2013.01); *A47B 73/008* (2013.01); *A47B 96/024* (2013.01); *A47B 96/1441* (2013.01); *A47B 47/0058* (2013.01); *A47B 57/58* (2013.01)

(58) Field of Classification Search

CPC ... A47B 73/00; A47B 73/008; A47B 47/0058; A47B 57/58; A47B 96/024; A47B 96/1441

See application file for complete search history.

(56) References Cited

U.S. PATENT DOCUMENTS

| | | | | | |
|---|---|---|---|---|---|
| 2,620,254 | A * | 12/1952 | Beckett | F25D 25/02 | 312/351 |
| 3,669,520 | A * | 6/1972 | Jansen | A47B 96/024 | 312/351 |
| 5,862,923 | A * | 1/1999 | Nordquist | A47F 1/121 | 211/59.2 |
| 6,328,170 | B1 * | 12/2001 | Lee | A47F 1/121 | 211/49.1 |
| 7,322,482 | B2 * | 1/2008 | Caradonna | A47B 73/004 | 211/74 |
| 7,377,397 | B2 * | 5/2008 | Lee | A47B 73/002 | 211/74 |
| 7,673,761 | B2 * | 3/2010 | Lee | F25D 25/02 | 211/183 |
| 10,827,834 | B2 * | 11/2020 | Wantland | A47B 73/008 | |
| 11,892,230 | B1 * | 2/2024 | Arresta | F25D 31/007 | |
| 11,910,921 | B2 * | 2/2024 | Grychta | F21S 8/00 | |
| 2005/0258118 | A1 * | 11/2005 | Lee | A47B 73/002 | 211/134 |

FOREIGN PATENT DOCUMENTS

WO WO-2008028204 A1 * 3/2008 ..... A47B 73/00

* cited by examiner

*Primary Examiner* — Ko H Chan
(74) *Attorney, Agent, or Firm* — Maier & Maier, PLLC

(57) ABSTRACT

A storage system for storing bottles including: a first support beam configured to engage a first panel; a second support beam configured to engage a second panel; a first crossbar; and a second crossbar, where the first crossbar and the second crossbar are supported by the first support bar and the second support bar.

16 Claims, 4 Drawing Sheets

STORAGE SYSTEM

FIELD

The present invention relates to storage systems, in particular consumer installable and adjustable storage systems for existing cupboards.

BACKGROUND

Storage systems for bottles are typically stand-alone storage units or racks onto which bottles are placed. Common examples include refrigerated storage units and bottle racks, which usually only allow bottles to be stored on their side.

Refrigerated units are large and often expensive items that occupy valuable floor space and require a power supply to function as intended. Similarly, a bottle rack is often a large piece of stand-alone furniture that also occupies valuable floor space and may not adequately protect bottles from accidental damage or disturbance which may arise from actions occurring in the area immediately around such racks. Refrigerated units and bottle racks are typically placed on the floor and are easily accessible by small children and pets thereby necessitating them to be kept in a dedicated secure room.

Many smaller modern homes do not have the required space to accommodate a refrigerated unit or a bottle rack, let alone a dedicated secure room to keep such units or racks. Additionally, such storage solutions often clash with the aesthetics of a modern home.

Further, the bottle storage capacity of both a refrigerated unit and a bottle rack is dependent on the size of the unit or rack which is determined by the manufacturer.

The location, expense, size, aesthetics, and storage capacity of both refrigerated units and bottle racks is often unnecessary or undesirable for many consumers.

It is therefore desirable for the present invention to provide an alternative and/or additional arrangement.

Reference to any prior art in the specification is not an acknowledgment or suggestion that this prior art forms part of the common general knowledge in any jurisdiction or that this prior art could reasonably be expected to be understood, regarded as relevant, and/or combined with other pieces of prior art by a skilled person in the art.

SUMMARY

A first aspect of the present invention provides a storage system for storing bottles including:

a first support element configured to be mounted to a first panel;

a second support element configured to be mounted to a second panel;

a first crossbar; and a second crossbar;

wherein the first crossbar and the second crossbar are supported by the first support element and the second support element.

A second aspect of the present invention provides a kit for a storage system for storing bottles including:

a first support element configured to be mounted to a first panel;

a second support element configured to be mounted to a second panel;

a first crossbar; and a second crossbar;

wherein when installed the first crossbar and the second crossbar are supported by the first support element and the second support element.

A third aspect of the present invention provides a method of installing a storage system for storing bottles including:

mounting a first support element to a first panel;

mounting a second support element to a second panel;

placing a first crossbar; and placing a second crossbar;

wherein the first crossbar and the second crossbar are supported by the first support element and the second support element.

In an embodiment, the first crossbar and the second crossbar, when in use, are positioned substantially perpendicular to the first support element and the second support element.

In an embodiment, the first panel and the second panel are oppositely disposed with respect to each other such that a support face of the first panel substantially faces a support face of the second panel. In a further embodiment, the support face of the second panel is disposed substantially parallel to the support face of the first panel.

In an embodiment, the first and second panels are opposing side panels of a cupboard.

In an embodiment, the first support element includes at least one support tab configured to engage the first panel, and the second support element includes at least one support tab configured to engage the second panel.

In an embodiment, the at least one support tab of the first support element is adjustable such that it is able to be positioned at any point along an adjustment length of the first support element, and the at least one support tab of the second support element is adjustable such that it is able to be positioned at any point along an adjustment length of the second support element. In a preferred embodiment, the adjustment length of the first support element extends along a majority of an entire length of the of the first support element and the adjustment length of the second support element extends along a majority of an entire length of the second support element.

In an embodiment, the at least one support tabs of the first and second support elements each include at least one support peg configured to engage a corresponding hole in the panels such that the at least one support peg is configured to insert into the corresponding hole.

In an embodiment, ends of the first and second support elements are provided with a projection that extends toward the respective first and second panels creating a first slot between the first support element and the first panel and a second slot between the second support element and the second panel.

In an embodiment, each end of the first and second crossbars are provided with a finger for extending into one of the first slot or the second slot to removably and adjustably secure each end of the first and second crossbars to the first and second support elements. In a further embodiment, the crossbar is slidably adjustable along the length of the first and second slots.

In an embodiment, the system further includes one or more additional crossbars.

In an embodiment, at least one of the first crossbar and the second crossbar is provided with at least one cradle such that the at least one cradle is removably and/or slidably attached to one of the first or second crossbars. In a further embodiment, the at least one cradle is configured to accommodate a body of a bottle for restricting movement of the bottle when the bottle is supported on the first and second crossbars for storage.

In an embodiment, the system further includes a beam lock configured to extend between adjacent first and second crossbars for limiting movement of the first and second crossbars with respect to each other. In a further embodiment, ends of the beam lock are configured to securely engage the first and second crossbars for restricting movement of one crossbar relative to another crossbar.

As used herein, except where the context requires otherwise, the term "comprise" and variations of the term, such as "comprising", "comprises" and "comprised", are not intended to exclude further additives, components, integers or steps.

Further aspects of the present invention and further embodiments of the aspects described in the preceding paragraphs will become apparent from the following description, given by way of example and with reference to the accompanying drawings.

DETAILED DESCRIPTION OF THE EMBODIMENTS

Figure 1:
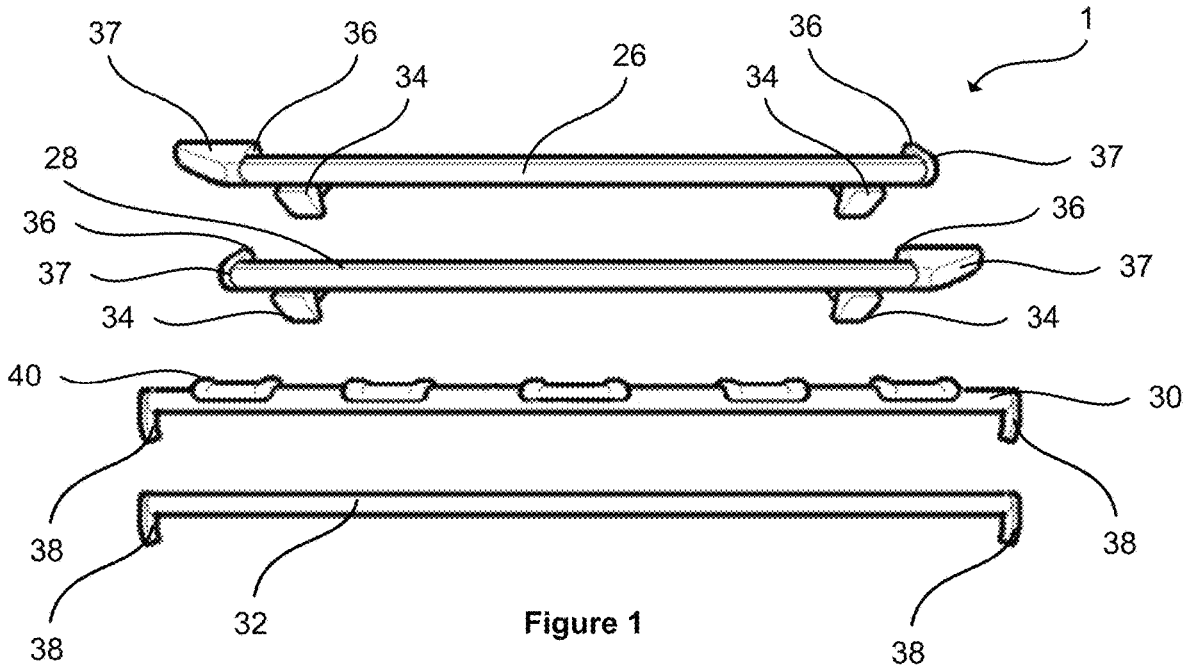
FIG. 1 is a perspective view of an embodiment of a storage system according to an embodiment of the present invention in a disassembled state.
Figure 2:
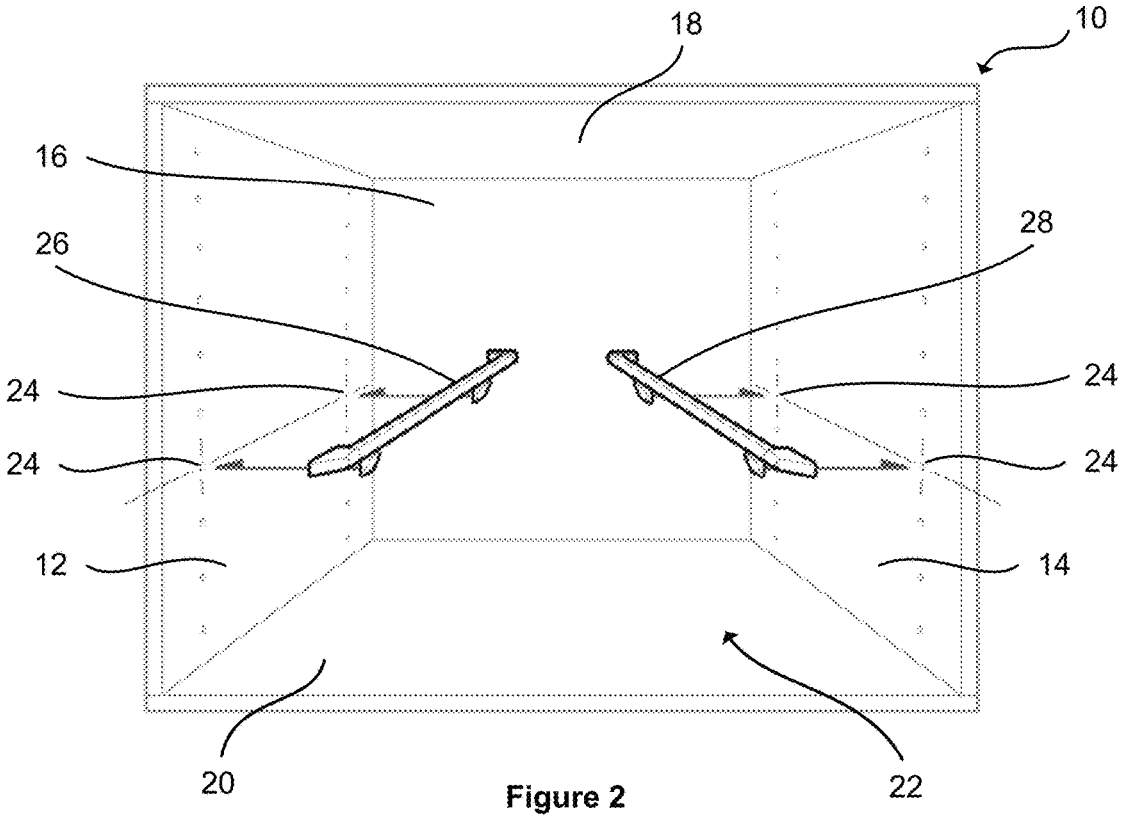
FIG. 2 is a perspective view of a pair of support elements of the storage system of FIG. 1 positioned for mounting to a cupboard.
Figure 3:
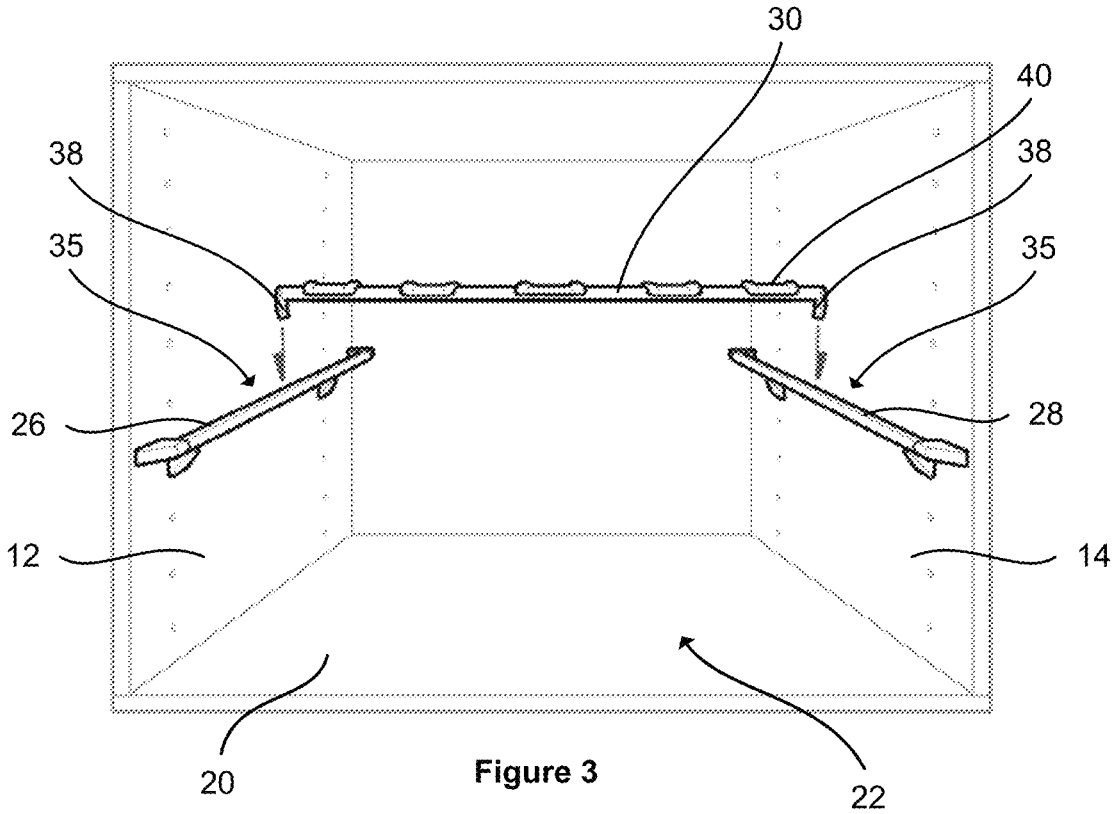
FIG. 3 is a perspective view of the storage system of FIG. 1 in a partial state of assembly.
Figure 4:
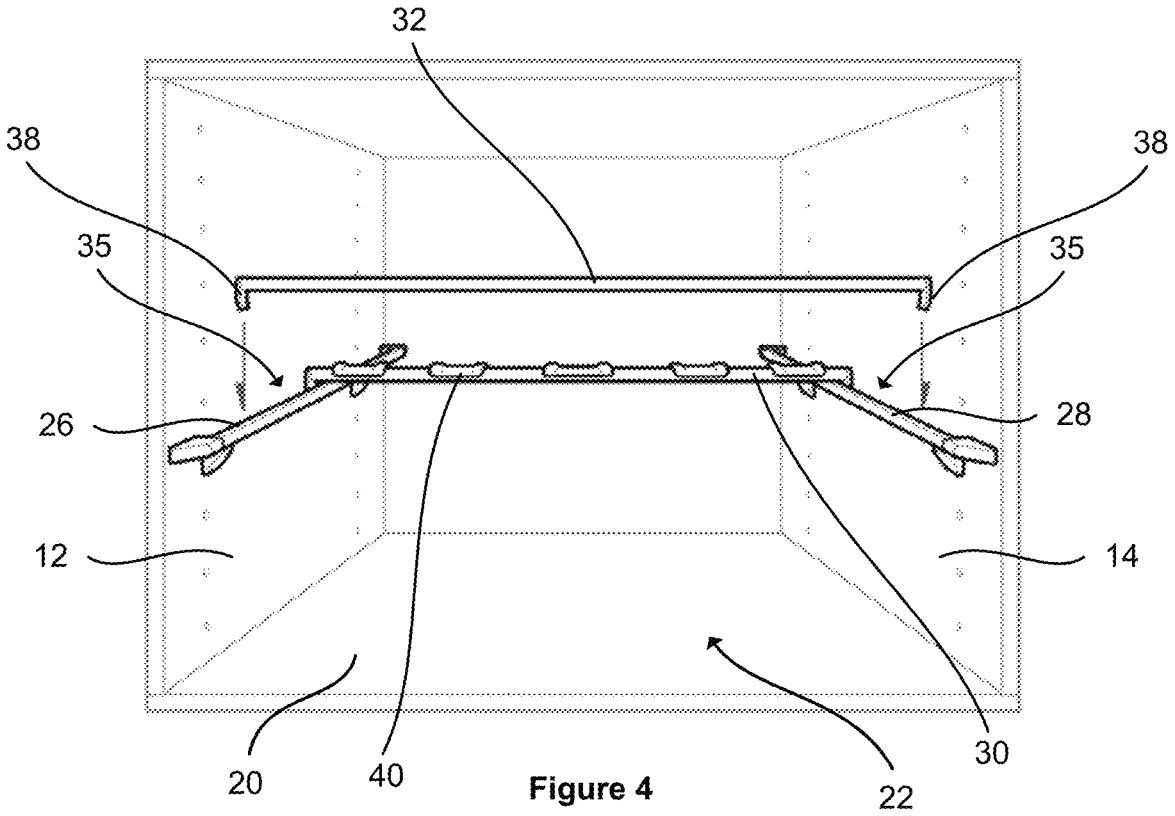
FIG. 4 is a perspective view of the storage system of FIG. 1 in a partial state of assembly.

Referring initially to the FIGS. 1 and 2, a storage system 1 for storing bottles includes a first support element in the form of a left side support beam 26 configured to be mounted to a first panel in the form of a left side panel 12 and a second support element in the form of a right side support beam 28 configured to be mounted to a second panel in the form of a right side panel 14. Referring also to FIGS. 3 and 4, the storage system 1 further includes a first crossbar in the form of a back crossbar 30 and a second crossbar in the form of a front crossbar 32 wherein the back crossbar 30 and the front crossbar 32 are supported by the left side support beam 26 and the right side support beam 28. The assembled storage system 1 is best shown in use in FIGS. 5 and 6, and more clearly in FIGS. 7 and 8.

Cupboards and cabinets (such as cupboard 10 as shown in FIGS. 2 to 6) are common storage units in homes and places of business. As shown, for example in FIG. 2, cupboard 10 includes left side panel 12, right side panel 14, a back panel 16, a top panel 18, and a bottom panel 20 which define a storage space 22. In some embodiments, cupboard 10 includes a front panel or door (not shown) to enclose the storage space 22.

The distance between then left and right side panels 12, 14 defines the width of the storage space 22. The distance between the bottom and top panels 20, 18 defines the height of the storage space 22. The depth of the enclosed space is defined by the distance between the back panel 16 and the front panel or open side of the storage space 22. The dimensions of the cupboard 10, and thus the dimensions of the storage space 22, vary depending on the location of installation or manufacturer.

Articles (such as bottles) are placed inside the cupboard 10 for storage and are typically supported by the bottom panel 20. Additionally, cupboards 10 often include one or more shelves (not shown), extending between the side panels 12, 14 (i.e. spanning the width of the enclosed space), to provide additional surfaces in the storage space 22 on which to place articles.

The shelves are usually installed into the storage space 22 of a cupboard 10 in one of two ways: the shelves are permanently fixed to the side panels 12, 14 of the cupboard 10; or the shelves are removably and adjustably supported between the side panels 12, 14 using support pegs.

The support pegs are partially inserted into a set of holes 24 drilled into the internal face of the left and right side panels 12, 14 of the cupboard 10 such that a portion of the peg extends outwardly from the side panels 12, 14 into the storage space 22. For adequate stability, a shelf panel will usually require at least 4 support pegs inserted into corresponding holes 24 in the side panels 12, 14 that are positioned towards the corner of the shelf. The shelf panel rests on the support pegs inserted into the holes 24 which transfer the load of the shelf into the side panels 12, 14.

One hole 24 is typically drilled in each side panel toward the front of the storage space 22 and one toward the back of the storage space 22. The distance between the holes 24 in the depth dimension will vary for different sizes of cupboards 10 (i.e. different depths of storage space 22). Additionally, the distance between these holes 24 may also vary between manufacturers of cupboards.

Multiple sets of holes 24 may be drilled into the left and right side panels 12, 14 of the cupboard at different distances from the bottom panel 20 to allow multiple shelves to be installed or the distance between the shelf and the bottom panel 20 (i.e. the height) of the shelf to be adjusted.

The storage system 1 preferably utilises at least one of these sets of predrilled holes 24 to provide an arrangement that can be fit to any existing cupboard 10. However, the set of holes need not be predrilled and may be created by the installer of the system allowing the system to be installed in any suitable cupboard.

Whilst the depicted embodiments include only two crossbars (back crossbar 30 and front crossbar 32) it will be appreciated that system 1 may include one or more additional crossbars, as desired.

Referring to FIGS. 1 and 2, the left and right side beams 26, 28 are elongate members that, in use, extend along the internal face of the side panels 12, 14 in the depth dimension of the storage space 22. The length of the side beams 26, 28 is less than the depth of the storage space 22 so that the side beams 26, 28 sit within the storage space 22.

It will be appreciated that the depth of the storage space 22 may vary between different cupboards. However, cupboards are often provided with standardised dimensions. For example, common depths include about 300 mm and about 560 mm. Accordingly, side beams 26, 28 of various lengths are contemplated to be compatible with the various depths. It will be appreciated that in other embodiments, side beams 26, 28 can be cut back to accommodate smaller depths, as required.

Figure 7:
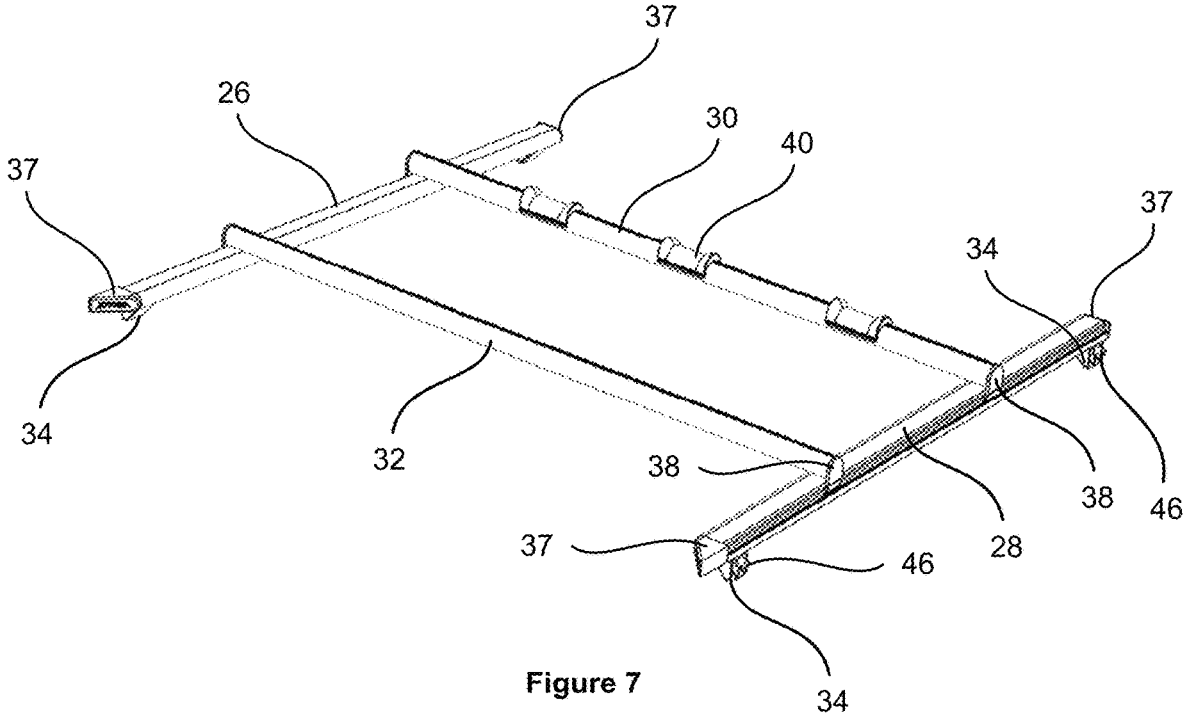
FIG. 7 is an isometric view of the storage system in an assembled state without the cupboard.

As shown in the illustrated embodiment of FIGS. 1 and 7, the left and right side beams 26, 28 each include support two tabs 34 located toward either end of the side beams 26, 28. However, in other embodiments, the side beams include one elongate support tab extending along the length of the side beam or alternatively include three or more discrete support tabs 34 located along the length of the side beams 26, 28.

The support tabs 34 are positioned to engage with the set of holes 24 drilled into the left and right side panels 12, 14 of a cupboard 10. Each support tab 34 includes at least one support peg 46 (best shown in FIGS. 7 and 8) configured to extend into one of holes 24 and dimensioned to provide a secure frictional interference fit. It will be appreciated that different dimension of hole may be found in different cupboards 10. Accordingly, the various sizes of support pegs 46 are be provided as an adjustable or interchangeable component secured to the support tabs.

As discussed above, the distance in the depth dimension between the holes 24 in the side panels 12, 14 may vary. The support tabs 34 are therefore adjustable to accommodate this variation in distance. Adjustability is achieved by the support tabs 34 being configured to be moveable along the length of the side beam 26, 28.

As best show in FIGS. 3 and 4, when installed, a small space or slot 35 is present between the side beams 26, 28 and the side panels 12, 14. The slot 35 is effected by projections 36 that extend away from the side beams 26, 28 toward the side panels 12, 14 so that the side beams 26, 28 are spaced away from the side panels 12, 14 when the support tabs 34 engage with the holes 24 in the side panels 12, 14.

In the exemplary embodiment depicted in FIG. 1 the projections 36 are provided via end caps 37 attached to either end of the side beams 26, 28. However, in other embodiments, the projections 36 are integrated into the side beams 26, 28. In yet other embodiments, one or more projections 36 are also located at any point along the length of the side beams 26, 28.

Figure 5:
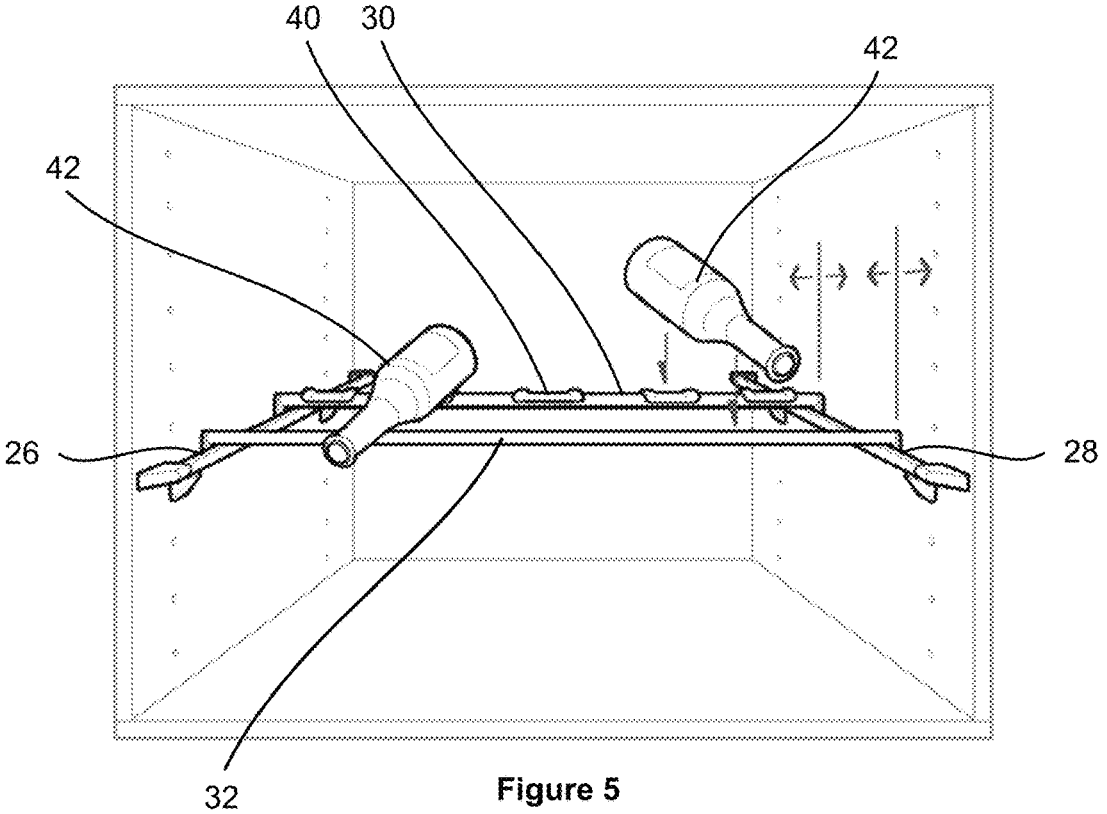
FIG. 5 is a perspective view of the storage system of FIG. 1 shown in an assembled state according to one configuration and in use.
Figure 6:
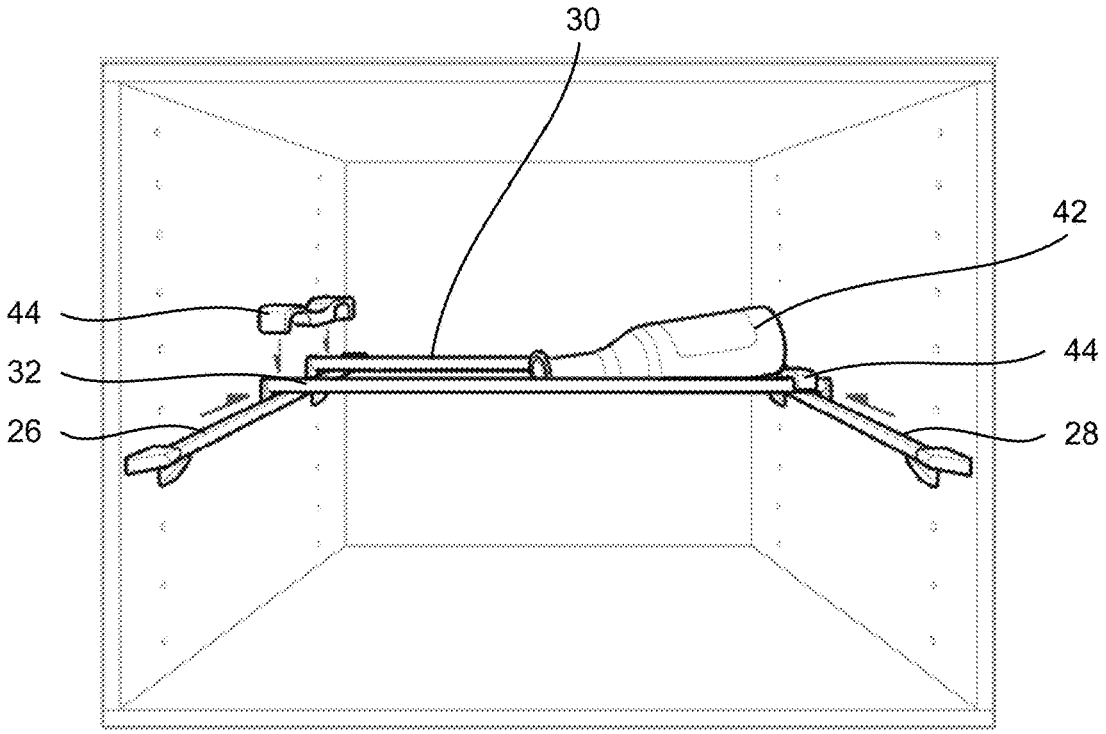
FIG. 6 is a perspective view of the storage system of FIG. 1 shown in an assembled state according to a further configuration and in use.

The crossbars 30, 32, as shown in FIG. 1, are elongate members that extend between the side panels 12, 14 across the width of the storage space 22. As shown in FIGS. 5 and 6, in use, crossbars 30, 32 are supported at either end by the side beams 26, 28. Similar to the dimensions of the side beams 26, 28, it will be appreciated that in other embodiments, crossbars 30, 32 can be cut back to accommodate smaller widths, as required.

Best depicted in FIGS. 3, 4 and 7, each end of the crossbars 30, 32 is provided with a finger 38 that extends from the ends of the crossbars 30, 32 down toward the bottom panel 20 of the storage space 22. The fingers 38 are dimensioned so as to fit within the slots 35 created between the side beams 26, 28 and side panels 12, 14. The crossbars 30, 32 are held in place by frictional contact between the fingers 38, the side panels 12, 14, and the side beams 26, 28. The frictional contact between the fingers 38, the side panels 12, 14, and the side beams 26, 28 is sufficient to hold the crossbars 30, 32 in place during normal usage. However, the crossbars 30, 32 can be removed and re-placed, and hence the location adjusted, as desired. With application of sufficient force, the crossbars 30, 32 can also be slid along an adjustment length of the support beams 26, 28 without removing the crossbars 30, 32. The adjustment length extends between end caps 37 of each of crossbars 30, 32.

This configuration allows the crossbars 30, 32 to be located at any point along the adjustment length of the side beams 26, 28. Thus, the distance in the depth direction between two crossbars (i.e. space between crossbars) can be adjusted as desired. Two such configurations where crossbars 30, 32 are spaced apart at different desired distances, are illustrated in FIGS. 5 and 6, which are described in further detail below.

It will be appreciated that the width of the storage space 22 will vary between existing cupboards or cabinets. As discussed above, cupboards or cabinets are often provided with standardised dimensions. For example, common widths of the enclosed space include about 450 mm, about 600 mm, and about 900 mm. Accordingly, crossbars of corresponding lengths are contemplated to be compatible with common widths.

The storage system 1 also includes one or more cradles 40 removably attached to either the back crossbar 30 or the front crossbar 32 to reduce the rolling movement of bottles 42 supported by the storage system 1. As depicted in FIG. 5, the front and back crossbars 30, 32 are spaced apart from each other such that the back crossbar 30, provided with one or more cradles 40, supports the body of a bottle 42 and the front crossbar 32 supports the neck of the bottle 42. The adjustable nature of the crossbars allows the space between the crossbars to be adjusted to accommodate bottles of various lengths.

Figure 8:
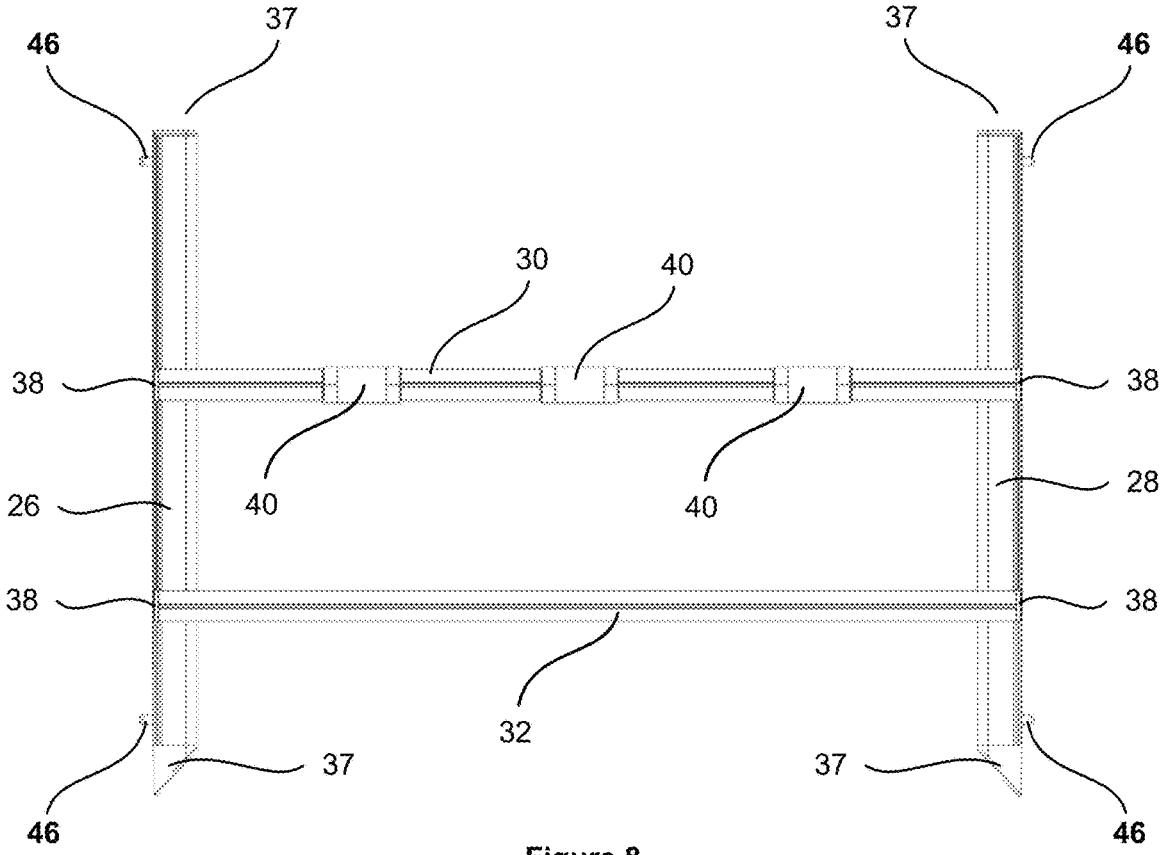
FIG. 8 is a top view of the storage system in an assembled state without the cupboard.

In the embodiment of FIGS. 5, 7 and 8 the cradles 40 are depicted on the back crossbar 30. However, in other embodiments, cradles are alternatively or additionally be included on the front crossbar 32 to allow different configurations of bottle storage to be achieved. Thus, the storage system 1 can be configured to store bottles 42 perpendicularly to the crossbars 30, 32, i.e. in the depth direction of the storage space 22.

The storage system 1 also includes one or more beam locks 44 (two are depicted in FIG. 6) to assist in securing two crossbars relative to one another in a fixed spacing arrangement. As shown in the embodiment of FIG. 6, either end of beam locks 44 is configured to engage a crossbar 30, 32. The rigid nature of the beam locks 44 aid to hold the crossbars 30, 32 at a fixed spacing and thus decrease the likelihood of movement of one cross crossbar relative to the other. Beam locks 44 are mounted towards each end of crossbars 30, 32 or, alternatively at any point along the length of the crossbars 30, 32.

Referring again to FIG. 6, the length of the beam lock 44 is preferably such that the spacing between the crossbars 30, 32 allows for a bottle 42 to sit between, and be supported by, the crossbars 30, 32 without falling between the crossbars. Beam locks 44 of different lengths are contemplated to allow for different spacing between crossbars 30, 32 and therefore accommodate bottles of different dimensions. Thus, the storage system 1 is able to be configured to store bottles parallel to the crossbars 30, 32 and the width direction of the storage space 22.

It will be appreciated that the above configuration can also be achieved without the use of beam locks 44 by simply placing the crossbars 30, 32 at the desired spacing. Whilst the beams locks provide additional security, the frictional contact between the fingers 38, the side panels 12, 14 and the side beams 26, 28 are able to hold the crossbars at the desired spacing.

Both the side beams 26, 28 and the crossbars 30, 32 are preferably made from a sufficiently stiff and strong material that can support the loads experienced by the system. For example, suitable materials contemplated include metals such as steels or aluminium, or plastics, polymers, or composite materials of sufficient stiffness and tensile strength to avoid bending when the system is in use. Other components of the system may be made of similar materials.

As shown in FIGS. 2 to 5, the storage system 1 may be assembled in cupboard 10 including predrilled holes 24 by firstly attaching the left and right side beams 26, 28 to the left and right sides panels 12, 14, respectively, of the cupboard 10. The support tabs 34 of the support beams 26, 28 may be adjusted to ensure the support beams 26, 28 engage with the side panels 12, 14. The back crossbar 30, front crossbar 32 are then placed on top of the support beams 26, 28 at the desired location. The fingers 38 on the ends of the crossbars 30, 32 are then inserted into the respective slots 35 between the support beams 26, 28 and the side panels 12, 14. The crossbars 30, 32 may optionally be adjusted to obtain the desired configuration. One or more cradles 40 are then mounted to the crossbar 30 through a mounting formation on each cradle 40 (not shown) that provides a secure interference fit onto crossbar 30. In embodiments, the one or more cradles 40 are mounted onto either of the crossbars 30, 32. In further embodiments, the one or more cradles 40 are slidably mounted onto the crossbars 30, 32 such that the position is adjusted by sliding the cradle along the length of the crossbar into position without having to lift the cradle off. As noted above, the assembled storage system 1 is depicted in FIGS. 7 and 8 with the cupboard omitted for clarity.

As described above, the adjustable nature of the storage system 1 allows the system to be configured to accommodate a wide range of bottle dimensions and can be configured to store bottles both parallel and perpendicularly to the crossbars.

Additionally, as the storage system 1 utilises simple holes drilled into the side panels of the cupboard the system may be cheaply, simply and quickly installed in any suitable existing cupboard. Further, as the storage system can be incorporated into any suitable cupboard, the system provides a bottle storage means that does not detract from the aesthetics of the modern home, does not utilise valuable floor space, and can be located away from pets and children.

Further, the storage system 1 is adapted to store items other than bottles that can be held by parallel crossbars 30, 32. Such items include (but are not limited to) shoes or balls. Further, parallel crossbars 30, 32 are able to support a solid, flat shelving surface to create a solid shelf.

It will be understood that the invention disclosed and defined in this specification extends to all alternative combinations of two or more of the individual features mentioned or evident from the text or drawings. All of these different combinations constitute various alternative aspects of the invention.

The invention claimed is:

1. A storage system for storing bottles, comprising:

a first support element configured to engage a first panel;

a second support element configured to engage a second panel;

a first crossbar; and a second crossbar, wherein the first crossbar and the second crossbar are supported by the first support element and the second support element, wherein the first support element includes at least one support tab configured to engage the first panel, and the second support element includes at least one support tab configured to engage the second panel, wherein the at least one support tab of the first support element is adjustable such that it is able to be positioned at any point along an adjustment length of the first support element, and the at least one support tab of the second support element is adjustable such that it is able to be positioned at any point along an adjustment length of the second support element.

2. The storage system of claim 1, wherein the first crossbar and the second crossbar, in use, are configured to be positioned substantially perpendicular to the first support element and the second support element.

3. The storage system of claim 1, wherein the first panel and the second panel are oppositely disposed with respect to each other such that a support face of the first panel substantially faces a support face of the second panel.

4. The storage system of claim 3, wherein the first and second panels are opposing side panels of a cupboard.

5. The storage system of claim 1, wherein the adjustment length of the first support element extends along a majority of an entire length of the first support element and the adjustment length of the second support element extends along a majority of an entire length of the second support element.

6. The storage system of claim 1, wherein the at least one support tab of each of the first and the second support elements each include at least one support peg configured to engage a corresponding hole in the panels.

7. The storage system of claim 1, wherein ends of the first and second support elements are provided with a projection that extends toward the respective first and second panels creating a first slot between the first support element and the first panel and a second slot between the second support element and the second panel.

8. The storage system of claim 7, wherein each end of the first and second crossbars is provided with a finger for extending into one of the first slot or the second slot to removably and adjustably secure each end of the first and second crossbars to the first and second support elements.

9. The storage system of claim 1, further including one or more additional crossbars.

10. The storage system of claim 1, wherein at least one of the first crossbar and the second crossbar is provided with at least one cradle such that the at least one cradle is removably attached to one of the first or second crossbars, wherein the at least one cradle is configured to accommodate a body of a bottle for restricting movement of the bottle when the bottle is supported on the first and second crossbars for storage.

11. The storage system of claim 1, further including a beam lock configured to extend between adjacent first and second crossbars for limiting movement of the first and second crossbars with respect to each other.

12. A kit for a storage system for storing bottles, comprising:

a first support element configured to be mounted to a first panel;

a second support element configured to be mounted to a second panel;

a first crossbar; and a second crossbar;

wherein when installed the first crossbar and the second crossbar are supported by the first support element and the second support element, wherein the first support element includes at least one support tab configured to engage the first panel, and the second support element includes at least one support tab configured to engage the second panel, wherein the at least one support tab of the first support element is adjustable such that it is able to be positioned at any point along an adjustment length of the first support element, and the at least one support tab of the second support element is adjustable such that it is able to be positioned at any point along an adjustment length of the second support element.

13. The kit of claim 12, wherein the at least one support tab of each of the first and the second support elements each include at least one support peg configured to engage a corresponding hole in the panels.

14. The kit of claim 12, wherein at least one of the first crossbar and the second crossbar is provided with at least one cradle such that the at least one cradle is removably attached to one of the first or second crossbars.

15. The kit of claim 12, further including a beam lock configured to extend between adjacent first and second crossbars for limiting movement of the first and second crossbars with respect to each other.

16. A method of installing a storage system for storing bottles, comprising:

mounting a first support element to a first panel:

mounting a second support element to a second panel;

placing a first crossbar; and placing a second crossbar;

wherein the first crossbar and the second crossbar are supported by the first support element and the second support element, wherein the first support element includes at least one support tab configured to engage the first panel, and the second support element includes at least one support tab configured to engage the second panel, wherein the at least one support tab of the first support element is adjustable such that it is able to be positioned at any point along an adjustment length of the first support element, and the at least one support tab of the second support element is adjustable such that it is able to be positioned at any point along an adjustment length of the second support element.

* * * * *